United States Patent [19]

Richardson et al.

[11] Patent Number: 4,655,794

[45] Date of Patent: Apr. 7, 1987

[54] LIQUID CLEANER CONTAINING VIABLE MICROORGANISMS

[75] Inventors: Ray O. Richardson, Virginia Beach, Va.; Anthony F. Bromirski, Spartanburg, S.C.; Lois T. Davis, Salem, Va.

[73] Assignee: Sybron Chemicals Holdings Inc., Birmingham, N.J.

[21] Appl. No.: 841,926

[22] Filed: Mar. 20, 1986

[51] Int. Cl.[4] ..... B24D 3/00

[52] U.S. Cl. ..... 51/293; 51/308; 51/309; 210/611; 252/89.1; 252/132; 252/174.25

[58] Field of Search ..... 51/293, 308, 309; 210/611, 150, 151; 252/89.1, 132, 174.25

[56] References Cited

U.S. PATENT DOCUMENTS

| | | | |
|---|---|---|---|
| 2,528,403 | 10/1950 | West | 210/610 |
| 3,997,460 | 12/1976 | Sirine et al. | 252/106 |
| 4,129,527 | 12/1978 | Clark et al. | 252/547 |
| 4,326,978 | 4/1982 | Moesch | 252/174.25 |
| 4,404,128 | 9/1983 | Anderson | 252/174.25 |
| 4,600,522 | 7/1986 | Grzeskowiak, Jr. | 252/174.25 |

OTHER PUBLICATIONS

Product Sale by Sybron Chemicals Inc., a subsidiary of Sybron Corporation, of "Gamazyme TD 500L" and other equivalent products. These products comprise a water solution which contains a detergent and bacterial spores or microorganisms. This product line has been on sale for over three years.

*Primary Examiner*—Paul Lieberman
*Assistant Examiner*—Willie J. Thompson
*Attorney, Agent, or Firm*—Marjama & Pincelli

[57] ABSTRACT

A cleaning composition which comprises a stable suspension of abrasive particles and viable microorganisms in a water solution containing a detergent.

12 Claims, No Drawings

LIQUID CLEANER CONTAINING VIABLE MICROORGANISMS

BACKGROUND OF THE INVENTION

Abrasive cleaners have long been utilized for cleaning. These products possess a physical "cutting" activity that is most effective in removing stubborn stains, deposits, and scum from fixtures, sinks, toilet bowls, and other surfaces. These products are particularly useful in cleaning toilets, sinks, and other surfaces which are then rinsed with the water and discharged to the sewer collection system; holding tanks, or septic systems. Almost universally, these products are highly alkaline or acidic, causing potential damage to beneficial microorganisms in the collection lines, sewer, septic systems, or holding tanks. In many applications this hostility to microbial activity is clearly a disadvantage.

Milder detergent products, on the other hand, which cause only minimal harm to microbial activity are generally useful only for light-duty cleaning applications including minor deposits of grease and dirt, but not including heavy mineral deposits, stains or particulates tightly adhering to fixtures, sinks, toilet bowls or other surfaces.

It is apparent that both commonly used types of cleaners such as highly alkaline, highly acidic, or milder detergent products suffer deficiencies, i.e., detrimental effect on drains, collection systems, and waste treatment systems or poor cleansing activity.

It is apparent that a product with strong surface cleansing properties that also actually increases microbial activity would actually extend benefits to include cleaner drain lines, and improved waste degradation. There has been a longstanding need for a product which provides the benefit of strong cleaning capabilities and actually seeds the waste collection and treatment system to improve its microbial activity instead of inhibiting activity.

SUMMARY OF THE INVENTION

The present invention comprises a stable suspension of abrasive particles and viable microorganisms or bacterial spores in a water solution containing a detergent. This composition has the advantage of being a good surface cleaning agent, and a good deep scouring agent, along with providing the beneficial effect of bacterial action to aid in sewage treatment.

DETAILED DESCRIPTION OF THE INVENTION

The composition of the present invention comprises a stable suspension of an abrasive and viable microorganisms in an aqueous detergent solution. This cleaning composition will improve the microbial activity in a waste collection or treatment system.

Abrasive particles in this case are of hydrophobic silica, however, any number of other abrasive materials, i.e., alumina and silicas such as clay, diatomaceous earth can be used as long as the pH of the suspension is stabilized within the range of about 5.0–9.0. In general the particle size range for the abrasive is from about 100 to 325 mesh. The abrasive component provides deep scouring and cleaning. The abrasive is held in suspension by a thickener. The abrasive material is generally present in a concentration of about 2 to 20 weight percent of the composition. Bentone EW, a water-dispersable clay manufactured by N.L. Chemicals may be used as a thickener, however, other thickeners well known to the art could also be used. The main purpose of the thickener is to keep the abrasive particles in suspension. Examples of such thickeners include many hydrophilic organic clay minerals.

The purpose of the detergent is for surface cleaning. Any suitable detergent or mixture of detergents may be used which are compatable with the other components of the composition. Typical detergents include nonionic surfactants such as the Triton series by Rohm & Haas, Igepal series by GAF, and Poly-Tergent B300 and B500 by Union Carbide all of which are nonylphenoxy polyethoxyethanol. The detergent is present in a concentration of about 1 to 20 weight percent of the composition.

Any viable microorganisms, or mixtures thereof, capable of surviving in the intended environment, and having the ability of degrading or promoting degradation of municipal type waste may be used with the composition of the present invention. Suitable types of organisms would include strains of Bacillus, Psuedomonas, Arthrobacter, Enterobacter, Citrobacter and Corynebacter. Bacillus genus is preferred because it not only has excellent waste degrading abilities but also produces a protected spore form. A preferred bacterial component includes two strains of *Bacillus subtilis* specifically adapted for high production of extracellular enzymes, particularly proteases, amylases, and cellulases. Such strains are common in waste treatment products.

It should be understood that bacteria of suitable microbial strains generally *Bacillus subtilis* may be specifically developed for the degradation of sanitary waste. Benefits include grease removal from drains and collection systems as well as improved degradation in treatment systems including but not limited to septic systems.

The composition of the present invention must be maintained at a relatively neutral pH in order to insure proper conditions for bacteria to germinate and actively degrade organics. The neutral pH also is beneficial to minimize skin irritation. Preferred pH activity range of product is between about 6.0 and 8.0, however, a range of about 5.0 to 9.0 would be acceptable. Product itself may have a wider pH range if bacteria are in spore form.

A suitable concentration level of viable microorganisms is about $1.0\times10^7$/ml., however, much lower concentrations could be effective in improving waste treatment depending on type of system to which it was introduced and amount of material used in cleaning. An operable concentration range for the microorganisms is from about $1\times10^6$/ml. to $1\times10^9$/ml. A preferred concentration is about $\geqq5\times10^6$.

The following publications illustrate a variety of microorganisms which may be suitable for use in the present invention.

Technical Bulletin and Lab Report Liquid Live Microorganisms from Stero Products, P.O. Box 7269, San Antonio, TX 78285

Bryan, A. C., "How Enzymes Improve Sludge Digestion." *Public Works,* 1969 (1952). p. 83.

Robinson, R. R., "Enzymes Give Good Results in Sewage Treatment Plant." *Public Works,* (1954). pp. 85, 116.

Corder, W. A., "Controlling a Grease Problem." *Water Sew. Works,* (1955), pp. 102, 42.

Chambers, J. V., "Improving Waste Removal Performance Reliability of a Waste Treatment System through Bioaugmentation." *Proc. 36th Ind. Waste Conf.*, Perdue University, West Lafayette, Inc. (1981).

Young, J. C., and Clark, J. W., "Second Order Equation for BOD." *J. Sanit. Eng. Div., Proc. Am. Soc. Civ. Eng.*, (1965), pp. 91, SA1, 4232.

Hand, Coleen, "Bacteria Cleaning Tanks for Navy, " *Landmark News Service in Roanoke Times & World News*, April 30, 1984, p. 2.

Haner, Steve, "Va. Firm's Mutant 'Bugs' Could Be an Answer to Toxic Wastes," *Associated Press, in Washington Business*, Nov. 29, 1982, p. 44

Hyde, C. S. 1981. "The Growing Business of Bacterial Cultures." *BioCycle.* 6: p. 25–27.

"Superbugs Soothe Sewage System." Engineering News Review. ENR. 1981 6: p. 28–29.

Tamborini, S. M., Richardson, D. S., and Horsfall, F. L. "A New Treatment for Biodegradable Waste." 40th Annual Meeting, International Water Conference, Oct. 30–Nov. 1. Pittsburgh, Pa. 1979.

Garner, C., "Bacterial Supplementation Aids Wastewater Treatment." *Public Works.* 111 (3): 1980. p. 71–72.

Mazer, Baig and Grenning, "Use of Bacteria to Reduce Clogging of Sewer Lines by Grease in Municipal Sewage," *Biological Control of Water Pollution.* ed. Tourbier and Piersow (University of Penna. Press, 1976), Chapter 28.

"Bacteria Solve Problems Created by Prisoners," *Public Works*, June, 1982.

Bower, G. C., "Bacteria: Their Role in the Sewage Treatment Process," Proceedings of Chesapeake Water Poll. Cont. Assn., 1972.

"Clean That Sewer System With Bugs," *Environmental Science & Technology*, October 1979.

Gardner, C., "Bacterial Supplementation Aids Wastewater Treatment," *Public Works Magazine*, March, 1980.

Gasner, L. L., "Microorganisms for Waste Treatment," in *Microbial Technology*, 2nd Ed., Vol. II, Ed. by Peppler, H. J. and Pearlman, D. Academic Press, Inc. 1978. Chapter 10.

"Grease-Eaters Clear Sewers," *Engineering News-Record*, Sept. 9, 1982, p. 12.

Grubbs, R. B., "Biotechnology is Taking its Place in Wastewater Treatment," Presented at Innovative and Alternative "Emerging" Technology Seminars, Sponsored by U.S. Environmental Protection Agency and Water and Wastewater Equipment Manufacturers, 1981.

Grubbs, R. B. "Bioaugmentation, What It Can and Cannot Do," 9th Engineering Foundation Conference on Environmental Engineering in the Food Processing Industry, 1979.

Grubbs, R. B., "Reducing Energy Needs Through Biotechnology," 5th Annual Convention of the Hawaii Water-Pollution Control Association, 1983.

Grubbs, R. B., "Value of Bioaugmentation for Operations and Maintenance of Wastewater Treatment Facilities," Symposium Proceedings of Wastewater Treatment Plant O & M Conference sponsored by U.S. Environmental Protection Agency, 1979.

Kirkup, R. A., and Nelson, L. R. "City Fights Grease and Odor Problems in Sewer System," *Public Works Magazine*, October, 1977.

The operating and preferred concentration ranges for the ingredients of the present invention are as follows in weight percent:

| | Operating Range | Preferred Range |
|---|---|---|
| Abrasive | 2–20% | 2–6% |
| Detergent | 1–20% | 3–7% |
| Thickener | 0.5–5% | 1–2% |
| Antisettling Agent | 0.5–5% | 1–2% |
| Microorganisms | $1 \times 10^6$/ml–$1 \times 10^9$/ml | $\geqq 5 \times 10^6$ |
| Water | Balance | Balance |

The following example illustrates one embodiment of the present invention. The percentages are in weight percent of the water except for the microorganisms which are defined by their concentration by number.

EXAMPLE

Into 1100 gallons tap water are added the following nutrients:

9.6 oz. yeast extract
29 ox. dextrose
9.6 oz. ammonium sulfate
40 oz. monosodium phosphate
2.2 lbs. sodium chloride This water mixture is sterilized for 30 minutes at 15 pounds pressure and 250 degrees F. The water mixture is cooled and innoculated with two selected strains of *Bacillus subtilis.* One comprises a strain selected for protease production and is designated Series 300 available from Sybron Chemicals Inc. The other comprises a strain selected for amylase production and is designated Series 200 available from Sybron Chemicals Inc. The bacteria is allowed to grow for 28 hours with aeration at 88° F. (Concentration of spores should be about $\geqq 1 \times 10^7$/ml.)

To the bacterial culture are added 0.5% perfume, and 5.0% nonionic surfactant (2.75% Poly-Tergent B300 and 2.25% Poly-Tergent B500), and 100 gm mint green dye by Hercules.

1% by weight of an antisettling agent (rheological additive MPA-1075 which is an olefinic polymeric complex available from N.L. Chemicals) is mixed into the water with high speed agitation for 2–4 hours to form a suspension. The antisettling agent aids in enhancing the stability of the suspension. 2% by weight of hydrophilic organic clay mineral (i.e., Bentone EW), as a thickening agent, is then mixed into the water at high speed. After a viscosity of about 1000–1500 cps is developed, 5% by weight of 160 mesh hydrophobic silica is mixed into the water until a homogeneous liquid mixture is formed.

This product has been used effectively to clean toilets. In one embodiment the product is squeezed out of a container onto a toilet brush or directly onto the side of the commode. The product is then scoured against the surface with the brush. Once the surface is clean, the product is flushed down the commode where the organisms are taken through the system to the final place of treatment. Here they help degrade sanitary waste, thereby increasing the action of the treatment system, i.e., septic tank, holding tank, etc. Once the organisms are diluted into water containing organics, they germinate and commence degradation of waste. They tend to adhere to the sidewalls of the entire collection system, forming a thin coating on all the pipes and the treatment vessel. This layer continues to grow and slough off new organisms into the system, thus, increasing the activity and helping to keep the piping and vessels free of grease and particulates. This product has been used with success in many types of collection and treatment systems including institutions, boats, city lines, etc. It also eliminates the need for chlorine containing cleaners that kill activity in treatment systems. The shelf life of the product is about two years if stored at temperatures between 33° and 110° F.

While the invention has been described in detail with respect to specific embodiments thereof, it will be understood by those skilled in the art that variations and modifications may be made without departing from the essential features thereof.

We claim:

1. A cleaning composition which comprises a stable suspension of abrasive particles with at least one material selected from the group consisting of hydrophobic silica, alumina, silica, and diatomaceous earth and viable microorganisms in an amount effective to degrade and promote the degregation of sanitary waste, in a water solution containing a detergent.

2. The composition of claim 1 in which the microorganisms are present in a concentration of about $1\times10^6$/ml to $1\times10^9$/ml.

3. The composition of claim 1 in which the pH of the composition is maintained in the range of about 5.0 to 9.0.

4. The composition of claim 1 in which the microorganism includes at least one organism from the group consisting of Bacillus, Pseudonmonas, Arthrobacter, Enterobacter, Citrobacter, and Corynebacter.

5. The composition of claim 1 in which the microorganis comprises at least one strain of *Bacillus subtilis.*

6. The composition of claim 1 which includes a thickener.

7. The composition of claim 6 which includes an antisettling agent.

8. A cleaning composition which comprises stable suspension of abrasive material and viable microorganisms in a water solution containing a detergent with the concentration of the microorganisms being in a range of about $1\times10^6$/ml. to $1\times10^9$/ml., said composition having a pH in the range of about 5.0 to 9.0.

9. The composition of claim 8 in which the microorganism includes at least one organism from the group consisting of Bacillus, Pseudomonas, Arthrobacter, Enterobacter, Citrobacter, and Corynebacter.

10. A cleaning composition which comprises a stable suspension of abrasive particles and viable microorganisms in a water solution containing a detergent having the following composition in weight percent:

| | |
|---|---|
| Abrasive | 2–20% |
| Detergent | 1–20% |
| Microorganisms | $1\times10^6$/ml. to $1\times10^9$/ml. |
| Water | Balance |

11. A cleaning composition which comprises a stable suspension of abrasive particles and viable microorganisms in a water solution containing a detergent having the following composition in weight percent:

| | |
|---|---|
| Abrasive | 2–6% |
| Detergent | 3–7% |
| Microorganisms | $1\times10^6$/ml. to $1\times10^9$/ml. |
| Water | Balance |

12. A cleaning composition which comprises a stable suspension of abrasive particles and viable microorganisms in a water solution containing a detergent having the following composition in weight percent:

| | |
|---|---|
| Abrasive | 2–20% |
| Detergent | 1–20% |
| Thickener | 0.5–5% |
| Antisettling Agent | 0.5–5% |
| Microorganisms | $1\times10^6$/ml. to $1\times10^9$/ml. |
| Water | Balance |

* * * * *